US010798490B2

(12) United States Patent
Zhong et al.

(10) Patent No.: US 10,798,490 B2
(45) Date of Patent: Oct. 6, 2020

(54) SOUNDING DEVICE WITH MULTI-LAYERED VOICE COIL HAVING LAYERS OF DIFFERING HEIGHTS

(71) Applicant: AAC Technologies Pte. Ltd., Singapore (SG)

(72) Inventors: Zhiwei Zhong, Shenzhen (CN); Wei Song, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/234,807

(22) Filed: Dec. 28, 2018

(65) Prior Publication Data

US 2019/0238990 A1 Aug. 1, 2019

(30) Foreign Application Priority Data

Jan. 29, 2018 (CN) ..... 2018 2 0169928 U

(51) Int. Cl.

| | |
|---|---|
| ***H04R 9/06*** | (2006.01) |
| ***H04R 7/12*** | (2006.01) |
| ***H04R 7/18*** | (2006.01) |
| ***H04R 9/02*** | (2006.01) |
| ***H04R 9/04*** | (2006.01) |

(52) U.S. Cl.

CPC ..... *H04R 9/06* (2013.01); *H04R 7/12* (2013.01); *H04R 7/18* (2013.01); *H04R 9/025* (2013.01); *H04R 9/046* (2013.01); *H04R 2499/11* (2013.01)

(58) Field of Classification Search

CPC ..... H04R 2499/11; H04R 2209/041

See application file for complete search history.

(56) References Cited

U.S. PATENT DOCUMENTS

2017/0223463 A1* 8/2017 Salvatti ..... H01F 5/06
2018/0007471 A1* 1/2018 Lembacher ..... H04R 1/2803

* cited by examiner

*Primary Examiner* — Walter F Briney, III

(74) *Attorney, Agent, or Firm* — IPro, PLLC; Na Xu

(57) ABSTRACT

The present disclosure provides a sounding device including a holder, a vibration system fixed to the holder, and a magnetic circuit system configured to drive the vibration system to vibrate and sound. The vibration system includes a diaphragm fixed to the holder and a voice coil that drives the diaphragm to vibrate. The magnetic circuit system has a magnetic gap in which the voice coil is inserted. The voice coil includes voice coil wire layers that are formed by winding a voice coil wire and include an intermediate layer, an outer layer, and an inner layer. Ends of the voice coil wire layers away from the diaphragm are aligned. A height of the outer layer and a height of the inner layer are smaller than a height of the intermediate layer. The intermediate layer is glued and fixed to the diaphragm.

8 Claims, 3 Drawing Sheets

SOUNDING DEVICE WITH MULTI-LAYERED VOICE COIL HAVING LAYERS OF DIFFERING HEIGHTS

CROSS-REFERENCE TO RELATED APPLICATIONS

The present application claims priority to Chinese Patent Application No. 201820169928.6, filed on Jan. 29, 2018, the content of which is incorporated herein by reference in its entirety.

TECHNICAL FIELD

The present disclosure relates to the acoustic and electric field and, in particular, to a sounding device applied to portable electronics.

BACKGROUND

With the advent of the mobile internet era, the number of smart mobile devices is continuously increasing. Among many mobile devices, mobile phones are undoubtedly the most common and portable mobile terminal device. A sounding device for playing sound is widely applied to the existing smart mobile devices such as a mobile phone.

In a speaker box of the related art, the sounding device includes a holder, a vibration system fixed to the holder, and a magnetic circuit system for driving the vibration system to vibrate and sound. The vibration system includes a diaphragm fixed to the holder and a voice coil for driving the diaphragm to vibrate.

However, in the related art, the voice coil is formed by winding a voice coil wire from outside to inside or from inside to outside, and the voice coil includes a plurality of voice coil wire layers. However, in the related art, the width of each of the voice coil wire layers is the same, i.e., the dimension in the vibration direction is the same. When the voice coil is glued to the diaphragm, since a bonding surface between the voice coil wire layers and the diaphragm is large after the voice coil wire layers are stacked, the glue is liable to overflow into the magnetic gap, thereby adversely affecting the acoustic performance of the sounding device.

Therefore, it is necessary to provide a new sounding device to solve the above technical problems.

BRIEF DESCRIPTION OF DRAWINGS

In order to more clearly illustrate technical solutions of embodiments of the present disclosure, the accompanying drawings used in the embodiments are briefly described below. The drawings described below are merely a part of the embodiments of the present disclosure. Based on these drawings, those skilled in the art can obtain other drawings without any creative effort.

DESCRIPTION OF EMBODIMENTS

The technical solutions in the embodiments of the present disclosure are clearly and completely described in details with reference to the accompanying drawings. The described embodiments are merely part of the embodiments of the present disclosure rather than all of the embodiments. All other embodiments obtained by those skilled in the art based on the embodiments of the present disclosure without paying creative labor shall fall into the protection scope of the present disclosure.

Figure 1:
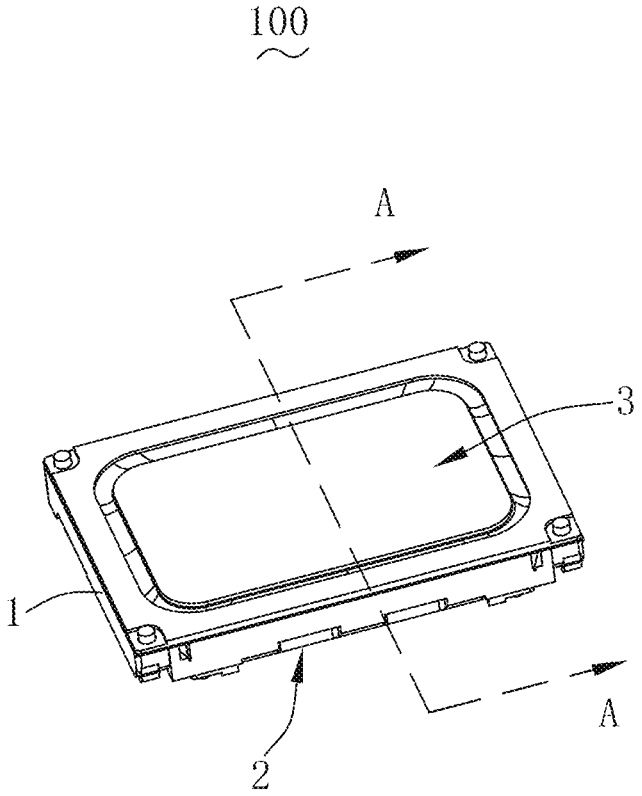
FIG. 1 is a schematic exploded perspective view of a sounding device according to an embodiment of the present disclosure.
Figure 2:
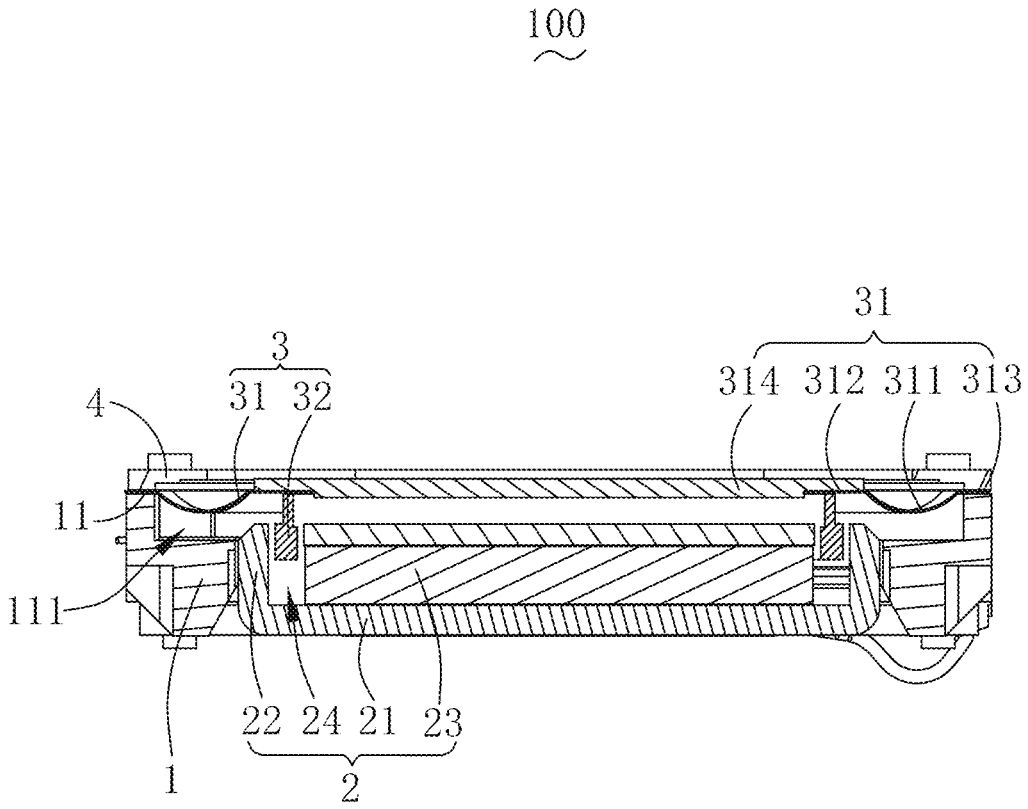
FIG. 2 is a cross-sectional view taken along line A-A in FIG. 1.

Referring to FIGS. 1-2, an embodiment of the present disclosure provides a sounding device 100. The sounding device 100 includes a holder 1, a magnetic circuit system 2, and a vibration system 3. The vibration system 3 and the magnetic circuit system 2 are respectively fixed to the holder 1. The magnetic circuit system 2 is configured to drive the vibration system 3 to vibrate and sound.

The magnetic circuit system 2 includes a magnetic yoke 21 fixed to the holder 1, a magnetic flanging 22 that is bent and extends from a periphery of the magnetic yoke 21, and a magnet 23 fixed to the magnetic yoke 21. The magnet 23 is spaced apart from the magnetic flanging 22 to form a magnetic gap 24.

The vibration system 3 includes a diaphragm 31 fixed to the holder 1 and a voice coil 32 for driving the diaphragm 31 to vibrate. The voice coil 32 is inserted and suspended in the magnetic gap 24. Referring to FIG. 2, the diaphragm 31 further comprises a suspension 311, a central portion 312 surrounded by the suspension 311, a positioning portion 313 surrounding the suspension 311, and a dome 314 attached to a side of the central portion 312 away from the voice coil 32; the suspension 311 bends towards the magnetic circuit system 2 to form an arc-shaped structure. The sounding device 100 further comprises a front cover 4, the front cover 4 is attached to a side of the diaphragm 31 away from the voice coil 32, and the positioning portion 313 is sandwiched between the holder 1 and the front cover 4. The holder 1 comprises a first surface 11 facing toward the diaphragm 31, the first surface 11 further recesses towards the direction away from the diaphragm 31 to form an avoidance part 111 for avoiding the suspension 311. Therefore, when the vibration amplitude of the diaphragm 31 is large, the suspension 311 also will not collide with the holder 1 and the front cover 4, and will not increase the overall height of the sounding device 100.

The voice coil 32 after being powered and the magnetic circuit system 2 generate an electromagnetic field. The magnetic field of the magnetic circuit system 2 drives the voice coil 32 to reciprocate in a direction perpendicular to the diaphragm 31, thereby driving the diaphragm 31 to vibrate and sound.

Figure 3:
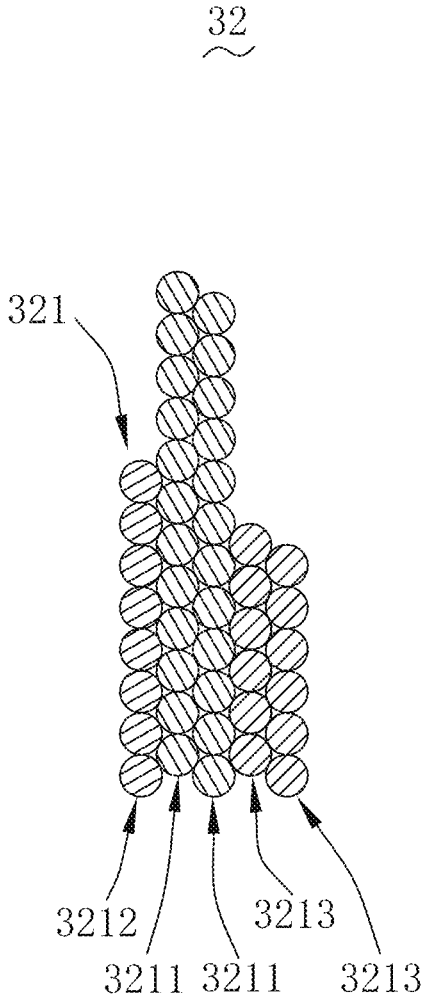
FIG. 3 is a schematic cross-sectional structural view of a voice coil of the sounding device according to an embodiment of the present disclosure.

Referring to FIG. 3, in particular, in an embodiment of the present disclosure, the voice coil 32 includes a plurality of voice coil wire layers 321 formed by winding a voice coil wire in sequence. The winding direction of the plurality of voice coil wire layers 321 is not limited, e.g., either a winding direction from inside to outside or a winding direction from outside to inside is feasible.

The plurality of voice coil wire layers 321 includes an intermediate layer 3211, an outer layer 3212 and an inner layer 3213, where the outer layer 3212 and the inner layer 3213 are located on opposite sides of the intermediate layer 3211, respectively.

The number of turns of the voice coil wire of each of the intermediate layer 3211, the outer layer 3212, and the inner layer 3213 is not limited, and each of the intermediate layer 3211, the outer layer 3212, and the inner layer 3213 may include one or more layers. In an embodiment of the present disclosure, the number of turns of the voice coil wire of the outer layer 3212 is different from the number of turns of the voice coil wire of the inner layer 3213.

For example, the number of turns of the voice coil wire of the outer layer 3212 is smaller than the number of turns of the voice coil wire of the inner layer 3213.

Specifically, in an embodiment of the present disclosure, the plurality of voice coil wire layers 321 includes five layers, and the intermediate layer 3211 includes at least one layer of the five layers. For example, the outer layer 3212 includes one layer, the intermediate layer 3211 includes two layers, and the inner layer 3213 includes two layers.

Each of the plurality of the voice coil wire layers 321 is at least partially suspended within the magnetic gap 24. Optionally, the outer layer 3212 and the inner layer 3213 are completely suspended within the magnetic gap 24.

Ends of the plurality of voice coil wire layers 321 away from the diaphragm 31 are aligned. A height of the outer layer 3212 and a height of the inner layer 3213 are smaller than a height of the intermediate layer 3211. The intermediate layer 3211 is glued and fixed to the diaphragm 31. With the above configuration, it is equivalent to reducing the area of the end of the voice coil 32 close to the diaphragm 31, i.e., reducing the area of a surface of the voice coil 32 attached to the diaphragm 31. Therefore, a space is provided for the overflowed glue when the voice coil 32 is glued to the diaphragm 31, so that the overflowed glue is prevented from falling into the magnetic gap 24 to affect the reliability of the sounding device 100. Moreover, with the above configuration, provided that a total length of the voice coil wire of the voice coil 32 is the same, a portion of the voice coil wire corresponding to the end of the voice coil 32 away from the diaphragm 31 occupies most of the total length, and this portion is suspended in the magnetic gap 24, thereby obtaining a greater driving force of the voice coil 32, and further improving the acoustic performance of the sounding device 100.

Compared with the sounding device in the related art, in the sounding device of the present disclosure, the voice coil is formed by winding a voice coil wire to form a plurality of voice coil wire layers, the height of the voice coil wire layer located in the middle is greater than that of the voice coil wire layers located at two sides thereof, ends of the plurality of voice coil wire layers away from the diaphragm are aligned and the voice coil wire layer in the middle is fixed to the diaphragm. With the above configuration, one the one hand, most of the voice coil wire of the voice coil are located in the magnetic gap, thereby providing a greater driving force, and improving the acoustic performance of the sounding device. On the other hand, the voice coil wire layer in the middle is glued and fixed to the diaphragm, which reduces the area of the surface of the voice coil bonded to the diaphragm, i.e., providing a space for the overflowed flue when the voice coil and the diaphragm are glued together. Therefore, the overflowed glue is prevented from flowing to the magnetic gap and further affecting the acoustic performance, and the reliability of the sounding device is improved.

The above are merely embodiments of the present disclosure. Here, it should be noted that those skilled in the art can make modifications without departing from the inventive concept of the present disclosure, but these modifications shall fall into the protection scope of the present disclosure.

What is claimed is:

1. A sounding device, comprising:

a holder, a vibration system fixed to the holder, wherein the vibration system comprises a diaphragm fixed to the holder and a voice coil that is configured to drive the diaphragm to vibrate, the voice coil comprises a plurality of voice coil wire layers formed by winding a voice coil wire in sequence, the plurality of voice coil wire layers comprises an intermediate layer, an outer layer and an inner layer, the outer layer and the inner layer being located on opposite sides of the intermediate layer, respectively, ends of the plurality of voice coil wire layers away from the diaphragm are aligned, a height of the outer layer and a height of the inner layer are smaller than a height of the intermediate layer, and the intermediate layer is glued and fixed to the diaphragm, the voice coil is only glued and fixed to the diaphragm through the intermediate layer, the outer layer and the inner layer all spaced apart from the diaphragm, and a number of turns of the voice coil wire of the outer layer is different from a number of turns of the voice coil wire of the inner layer, the number of turns of the voice coil wire of the outer layer is smaller than the number of turns of the voice coil wire of the inner layer, a magnetic circuit system configured to drive the vibration system to vibrate and sound, wherein the magnetic circuit system is provided with a magnetic gap in which the voice coil is inserted.

2. The sounding device as described in claim 1, wherein the plurality of voice coil wire layer comprises five layers, and the intermediate layer comprises at least one layer of the five layers.

3. The sounding device as described in claim 2, wherein the outer layer comprises one layer of the five layers, the intermediate layer comprises two layers of the five layers, and the inner layer comprises two layers of the five layers.

4. The sounding device as described in claim 1, wherein each of the plurality of voice coil wire layers is at least partially suspended within the magnetic gap.

5. The sounding device as described in claim 4, wherein the outer layer and the inner layer are completely suspended within the magnetic gap.

6. The sounding device as described in claim 1, wherein the diaphragm further comprises a suspension, a central portion surrounded by the suspension, a positioning portion surrounding the suspension, and a dome attached to a side of the central portion away from the voice coil; the suspension bends towards the magnetic circuit system to form an arc-shaped structure.

7. The sounding device as described in claim 6, wherein the holder comprises a first surface facing toward the diaphragm, the first surface further recesses towards the direction away from the diaphragm to form an avoidance part for avoiding the suspension.

8. The sounding device as described in claim 7, wherein the sounding device comprises a front cover, the front cover is attached to a side of the diaphragm away from the voice coil, and the positioning portion is sandwiched between the holder and the front cover.

* * * * *